US009205568B2

(12) United States Patent
Garavaglia et al.

(10) Patent No.: US 9,205,568 B2
(45) Date of Patent: Dec. 8, 2015

(54) AMBIDEXTROUS UTILITY KNIFE

(75) Inventors: Joseph P. Garavaglia, Newport Beach, CA (US); Brandon L. Spoelstra, Costa Mesa, CA (US); Markus E. Gropl, Huntington Beach, CA (US); Mark Marinovich, Rancho Santa Fe, CA (US)

(73) Assignee: PACIFIC HANDY CUTTER, INC., Irvine, CA (US)

( * ) Notice: Subject to any disclaimer, the term of this patent is extended or adjusted under 35 U.S.C. 154(b) by 818 days.

(21) Appl. No.: 13/285,484

(22) Filed: Oct. 31, 2011

(65) Prior Publication Data

US 2013/0104405 A1 May 2, 2013

(51) Int. Cl.
*B26B 5/00* (2006.01)
*B26B 29/02* (2006.01)

(52) U.S. Cl.
CPC ..... *B26B 5/001* (2013.01); *B26B 29/02* (2013.01)

(58) Field of Classification Search
CPC ..... B26B 29/02; B26B 5/001
See application file for complete search history.

(56) References Cited

U.S. PATENT DOCUMENTS

| | | | | | |
|---|---|---|---|---|---|
| 2,247,290 | A | * | 6/1941 | Disbrow | 30/2 |
| 2,650,422 | A | * | 9/1953 | Soltow et al. | 30/154 |
| 3,518,758 | A | * | 7/1970 | Bennett | 30/154 |
| 3,851,986 | A | * | 12/1974 | Daughtry | 403/373 |
| 3,978,584 | A | | 9/1976 | Mayer | |
| 4,226,020 | A | | 10/1980 | Quenot et al. | |
| 4,872,231 | A | * | 10/1989 | Gustavsen | 7/103 |
| 4,912,349 | A | * | 3/1990 | Chang | 310/50 |
| 5,012,581 | A | * | 5/1991 | Fletcher et al. | 30/162 |
| 5,386,632 | A | | 2/1995 | Schmidt et al. | |
| 5,502,896 | A | | 4/1996 | Chen | |
| 5,535,947 | A | | 7/1996 | Hogue et al. | |
| 5,613,300 | A | | 3/1997 | Schmidt et al. | |
| 5,659,959 | A | | 8/1997 | Parlowski | |
| D413,247 | S | | 8/1999 | Schmidt | |
| 6,008,586 | A | | 12/1999 | Norman | |
| D433,304 | S | | 11/2000 | Schmidt | |
| D435,419 | S | | 12/2000 | Schmidt | |
| 6,314,646 | B1 | | 11/2001 | Schmidt | |
| D475,910 | S | | 6/2003 | Schmidt | |
| 6,637,112 | B2 | * | 10/2003 | Davis | 30/2 |
| 6,675,485 | B1 | * | 1/2004 | Shih et al. | 30/321 |
| 6,973,726 | B2 | | 12/2005 | Kramer | |
| 7,082,688 | B2 | * | 8/2006 | Votolato | 30/293 |
| D544,774 | S | | 6/2007 | Schmidt | |

(Continued)

FOREIGN PATENT DOCUMENTS

WO WO 2013/066875 * 5/2013

OTHER PUBLICATIONS

PCT/US2012/062587: International Search Report, Mar. 1, 2013.

(Continued)

*Primary Examiner* — Hwei C Payer

(74) *Attorney, Agent, or Firm* — Henricks, Slavin & Holmes LLP

(57) ABSTRACT

A cutter apparatus includes a housing configured for gripping by a hand, a blade holder and/or blade coupled to the housing, a guard secured to the housing, and a handle coupled to the housing via an engagement interface configured to allow a user of the cutter apparatus to selectively interfit together the housing and the handle in multiple different cutter apparatus configurations including a pair of configurations in which the guard, in relation to each configuration, faces the blade from right and left sides, respectively, of the cutter apparatus.

11 Claims, 13 Drawing Sheets

(56) References Cited

U.S. PATENT DOCUMENTS

| | | | | |
|---|---|---|---|---|
| 7,287,331 | B2 * | 10/2007 | Sasaki et al. | 30/519 |
| 7,475,480 | B2 | 1/2009 | Votolato | |
| 7,958,642 | B2 | 6/2011 | Rosskamp | |
| 7,987,602 | B2 | 8/2011 | Kanemoto et al. | |
| 8,003,504 | B2 | 8/2011 | Immorlica et al. | |
| 8,156,656 | B2 * | 4/2012 | Tate et al. | 30/392 |
| 8,572,852 | B1 * | 11/2013 | Jennings et al. | 30/162 |
| 8,739,414 | B2 * | 6/2014 | Tyers | 30/162 |
| 2005/0172416 | A1 | 8/2005 | Feliciano | |
| 2005/0188552 | A1 * | 9/2005 | Gist et al. | 30/392 |
| 2005/0217114 | A1 * | 10/2005 | Votolato | 30/2 |
| 2007/0289148 | A1 * | 12/2007 | Zhang et al. | 30/392 |
| 2008/0086895 | A1 | 4/2008 | Parks | |
| 2009/0090224 | A1 * | 4/2009 | Lin | 81/177.2 |
| 2009/0255129 | A1 * | 10/2009 | Gringer et al. | 30/162 |
| 2009/0266210 | A1 * | 10/2009 | Chung et al. | 83/144 |
| 2010/0037468 | A1 | 2/2010 | Rowlay et al. | |
| 2010/0293796 | A1 | 11/2010 | Votolato | |
| 2012/0023753 | A1 * | 2/2012 | Wen | 30/156 |
| 2012/0304472 | A1 * | 12/2012 | Medhurst | 30/162 |
| 2013/0097876 | A1 * | 4/2013 | Fong et al. | 30/277.4 |
| 2013/0104405 | A1 * | 5/2013 | Garavaglia et al. | 30/295 |
| 2013/0305539 | A1 * | 11/2013 | Garavaglia et al. | 30/122 |

OTHER PUBLICATIONS

PCT/US2012/062587: Written Opinion, Mar. 1, 2013.
U.S. Appl. No. 13/765,605: Non-Final Rejection, Nov. 7, 2014.

* cited by examiner

AMBIDEXTROUS UTILITY KNIFE

TECHNICAL FIELD

The present invention relates generally to cutters and, in particular, an ergonomic hand tool such as a cutter and a reconfigurable housing and/or handle for same.

BACKGROUND ART

A great variety of knives, cutters, safety cutters, and cutter apparatuses are known. Features variously found in prior knives, cutters, safety cutters, and cutter apparatuses include mechanisms and devices facilitating, for example, blade deployment, blade locking, blade depth adjustment, blade change, or blade storage. Various ergonomic devices and apparatuses are also known.

It is known to provide a safety cutter with a guard (or guide) located a short distance from and facing a side of the cutting blade. See e.g., U.S. Pat. Nos. 5,386,632, 6,314,646 B1, D544,774 S, and 7,987,602 B2, which are hereby incorporated by reference.

Unfortunately, manufacturers or providers of such safety cutters, to accommodate a greater number of customers and operational considerations, must make available two different product versions, namely, a right-handed device in which the guard faces one side of the cutting blade and a left-handed device in which the guard faces the opposite side of the cutting blade. This, in turn, creates potential consumer confusion as to which version of the product might be best suited for a particular user or cutting operation. Moreover, twice as much shelf frontage is required to display two versions (rather than one version) of a product.

It would be useful to be able to provide one or more of: a guarded cutter (i.e., a cutter including or provided with a guard) that eliminates or lessens the need to provide both left- and right-handed versions of the cutter; a cutter with a mechanism or device that facilitates an improved, advantageous, or otherwise desirable or useful blade change operation for the cutter; and a cutter with a mechanism or device that facilitates improved, advantageous, or otherwise desirable or useful blade storage within the cutter.

SUMMARY OF THE INVENTION

In an example embodiment, a cutter apparatus includes a housing with a blade carrier configured for holding a blade in multiple different cutting edge orientations in relation to the housing, the cutting edge orientations including a pair of cutting edge orientations that are mirror images of each other, and a handle coupled to the housing via an engagement interface configured to allow a user of the cutter apparatus to selectively interfit together the housing and the handle in multiple different cutter apparatus configurations including a pair of configurations which, in conjunction with cutting edge orientations respectively selected from the pair of mirror image cutting edge orientations, accommodate ambidextrous operation of the cutter apparatus.

In an example embodiment, a cutter apparatus includes a housing, configured for holding a blade, and a handle coupled to the housing via an engagement interface configured to allow a user of the cutter apparatus to selectively interfit together the housing and the handle in multiple different cutter apparatus configurations including a pair of configurations accommodating left and right-handed operation of the cutter apparatus, respectively.

In an example embodiment, a cutter apparatus includes a housing configured for gripping by a hand, a blade holder and/or blade coupled to the housing, a guard secured to the housing, and a handle coupled to the housing via an engagement interface configured to allow a user of the cutter apparatus to selectively interfit together the housing and the handle in multiple different cutter apparatus configurations including a pair of configurations in which the guard, in relation to each configuration, faces the blade from right and left sides, respectively, of the cutter apparatus.

In an example embodiment, a cutter apparatus includes a housing with a blade carrier, and a handle coupled to and repositionable in relation to the housing to multiple different engagement positions at which the housing and the handle are secured together, the housing and the handle being configured such that when not secured together the housing and the handle remain coupled together and are repositionable in relation to each other.

In an example embodiment, a cutter apparatus includes a distal portion including a housing with an opening, a blade carrier coupled to and repositionable in relation to the housing, and multiple cut guards, and a proximal portion coupled to the distal portion such that the portions are repositionable in relation to and interfit with each other in multiple different configurations in which the portions are secured together and a different cut guard is positioned for contact with a workpiece for each of the configurations.

In an example embodiment, a cutter apparatus includes a housing, a blade holder coupled to the housing, and multiple guards coupled to the housing, at least two of the guards being fixed in position in relation to each other.

In an example embodiment, a cutter apparatus includes a housing configured for gripping by a hand, a blade holder and/or a blade coupled to the housing, and a blade storage assembly that is coupled to the housing and rotatably repositionable about an axis parallel or substantially parallel to a longitudinal axis associated with the blade holder and/or the blade.

In an example embodiment, a cutter apparatus includes a housing configured for gripping by a hand, a blade holder and/or a blade coupled to the housing, and a blade storage assembly coupled to and repositionable in relation to a portion of the housing, the blade storage assembly including a blade storage compartment configured for holding spare blades and a plurality of springs configured to secure blades within the blade storage compartment and prevent the blade storage assembly from being completely removed from the housing.

In an example embodiment, a cutter apparatus includes a housing, a blade carrier coupled to the housing and repositionable in relation to the housing, and multiple safety actuators configured to disengage, when a plurality of the safety actuators are activated, one or more interlocks that prevent the blade carrier from being repositioned for a blade change operation.

DISCLOSURE OF INVENTION

Figure 1:
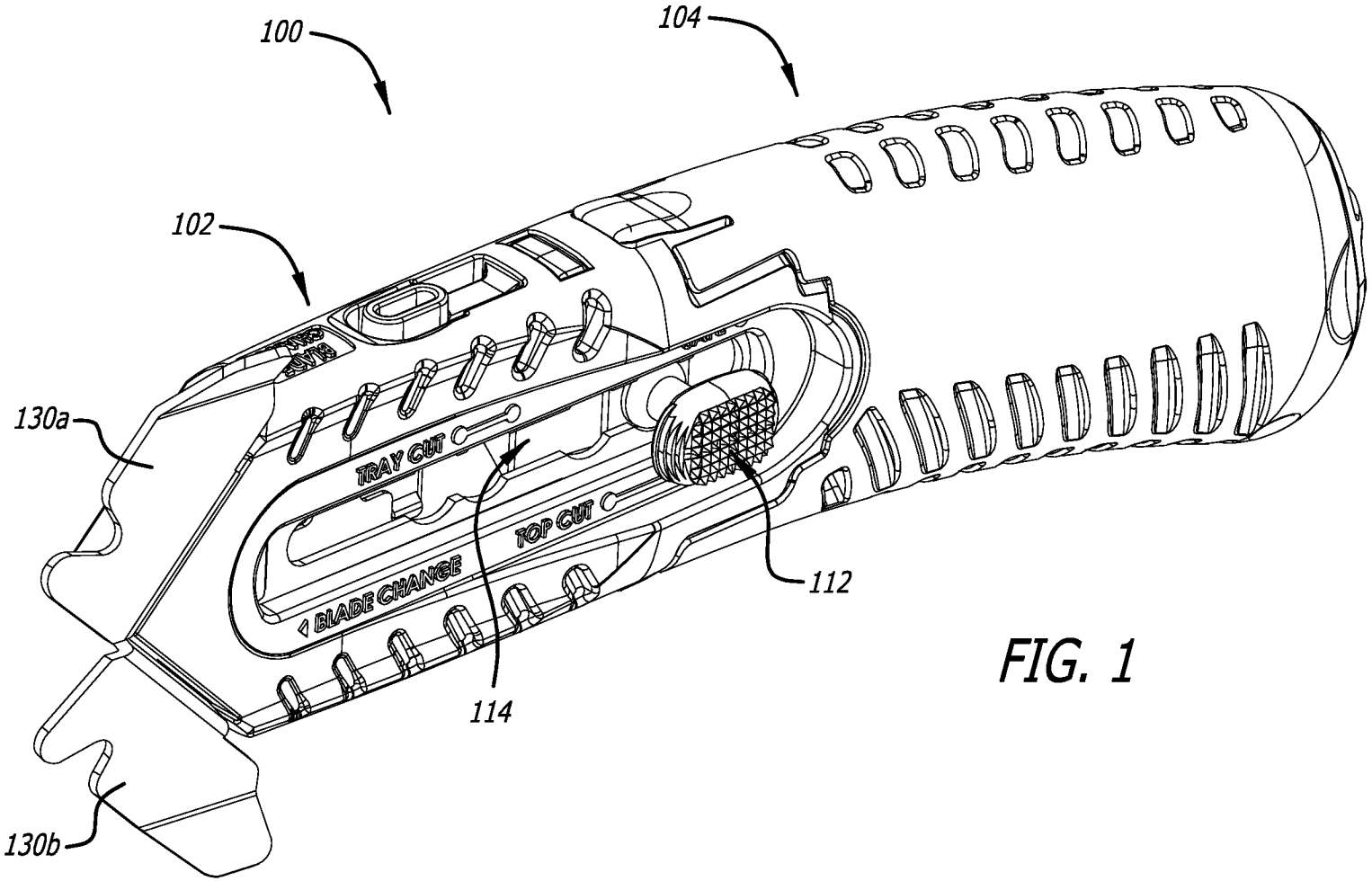
FIG. 1 is a perspective view of an example embodiment of a cutter apparatus.

Referring to FIGS. 1, 2A, 2B, 3, and 4, in this example embodiment, a cutter apparatus 100 includes a housing portion (or body front) 102 and a handle portion (or body rear) 104 configured to be coupled or interfitted in multiple different cutter apparatus configurations. The housing portion 102 and the handle portion 104 can be formed of various materials, for example, a thermoplastic that has high strength, rigidity, and impact resistance (e.g., Acrylonitrile butadiene styrene (ABS)), and by various processes (e.g., injection molding).

The handle portion 104 is coupled to the housing portion 102 via an engagement interface 106 (e.g., configured as shown). In this example embodiment, the engagement interface 106 is configured to allow a user of the cutter apparatus 100 to selectively interfit together the housing portion 102 and the handle portion 104 in multiple different cutter apparatus configurations.

The cutter apparatus 100 includes a channel/guard structure 108 secured to the housing portion 102 (e.g., fixedly secured by complementary surfaces or portions of the housing) and a blade carrier (or blade holder) 110 with a blade activation button 112. In this example embodiment, the channel/guard structure 108 includes or defines a channel 109 configured to support the blade carrier 110 such that the blade carrier 110 is repositionable along the channel 109. The channel/guard structure 108 can be formed of various materials, for example, a material made of or including a metal (or a metal alloy or a plastic) that has high strength and wear resistance (e.g., steel), and by various processes (e.g., progressive die stamping). The blade carrier 110 can be formed of various materials, for example, a material made of or including a metal (or a metal alloy or a plastic) that has high strength and wear resistance (e.g., stainless steel), and by various processes (e.g., progressive die stamping). The blade activation button 112 can be formed of various materials, for example, a zinc alloy (e.g., Zamak 2), and by various processes (e.g., die cast).

Figure 4:
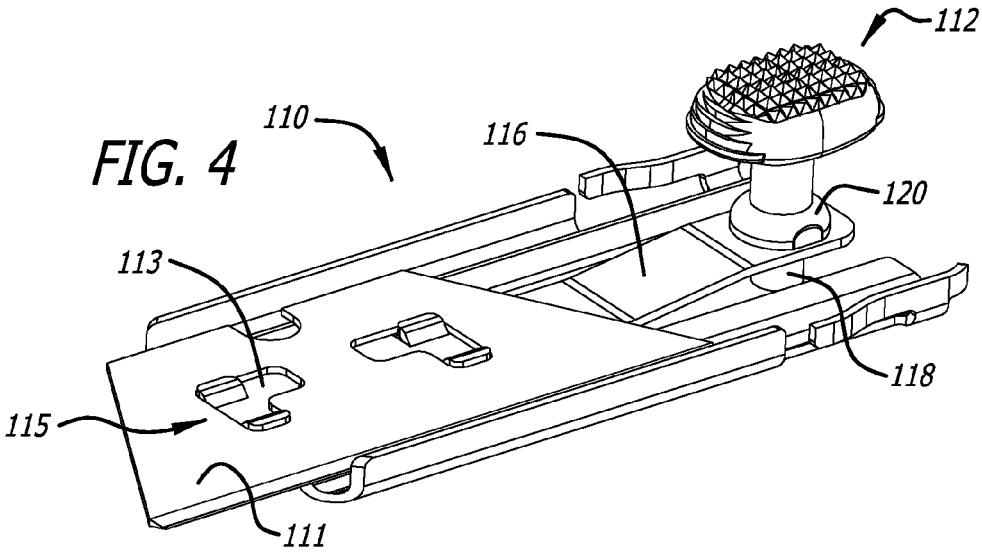
FIG. 4 is a perspective view of the blade carrier and the blade activation button of FIG. 3 shown assembled and with a blade positioned on the blade carrier.
Figure 4A:
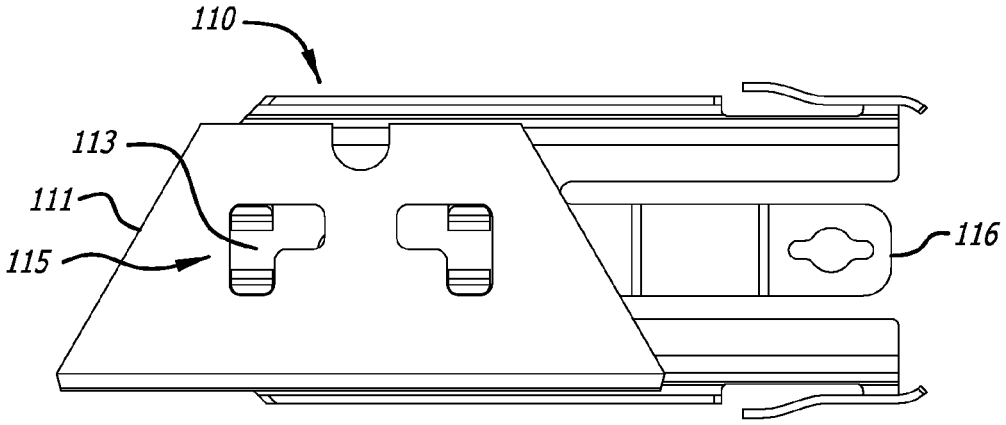
FIGS. 4A and 4B show a pair of cutting edge orientations that are mirror images of each other.
Figure 4B:
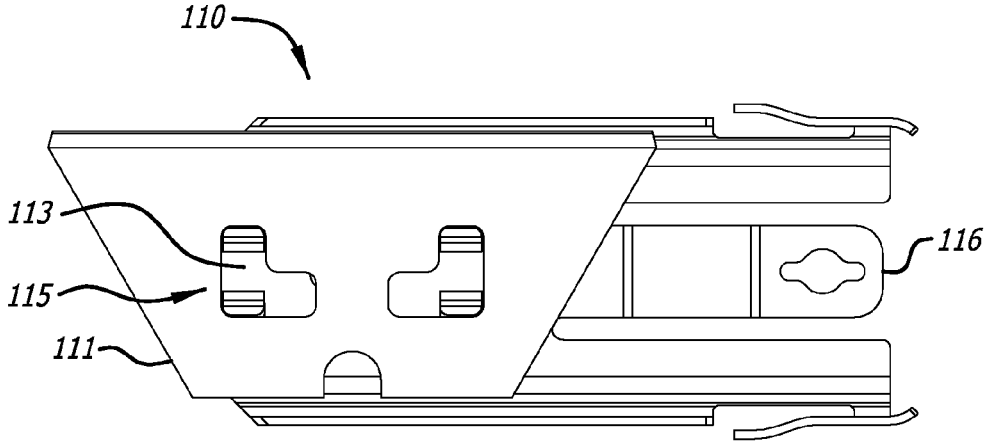

Referring additionally to FIGS. 4A and 4B, in this example embodiment, the blade carrier 110 is configured to hold a blade 111 in multiple different cutting edge orientations (e.g., with the blade 111 secured between the blade carrier 110 and one or more portions of the channel/guard structure 108). In this example embodiment, the blade carrier 110 and a blade 111 are configured such that the multiple different cutting edge orientations include a pair of mirror image cutting edge orientations.

In example embodiments, the blade carrier 110 and the blade 111 are configured with symmetrical complementary engagement portions. By way of example, a substantially flat surface (or portion) 113 of the blade carrier 110 includes or is provided with protrusions 115 (e.g., fixed tabs or other raised structures shaped and positioned as shown) configured to accommodate positioning the blade 111 adjacent to the substantially flat surface 113 with the protrusions 115 extending through one or more apertures in the blade and/or engaging complementary surfaces of the blade preventing the blade from repositioning along the blade carrier 110.

Figure 5:
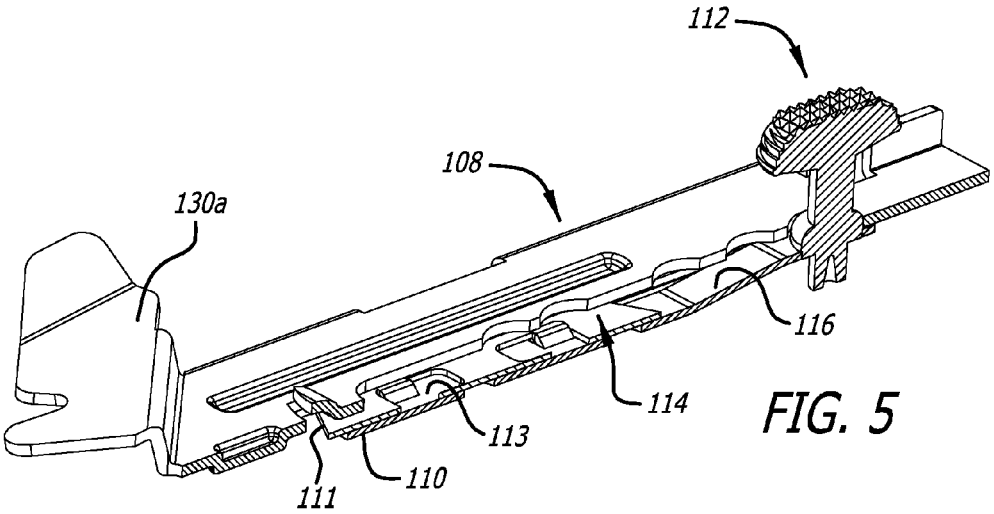
FIG. 5 is a cross-sectional perspective view of the channel/guard structure of FIG. 3 shown with the blade activation button (of the blade carrier) at a safe position along a guide channel (of the channel/guard structure)
Figure 6:
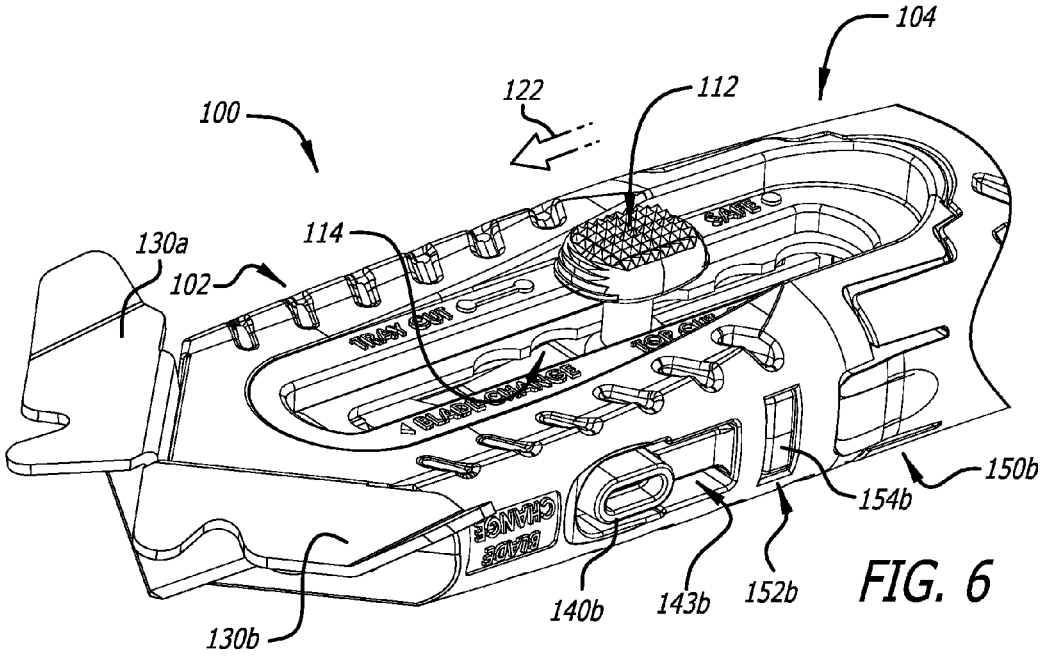
FIG. 6 is a partial perspective view of the cutter apparatus of FIG. 1, the blade activation button is shown repositioning along the guide channel from a top cut position to a tray cut position.

In example embodiments, the blade carrier 110 is coupled to and repositionable in relation to (e.g., along a channel defined by) the channel/guard structure 108 and/or one or more other portions or components of the cutter apparatus 100. In this example embodiment, the channel/guard structure 108 includes or is provided with a guide channel 114 (e.g., as shown) and the blade carrier 110 includes or is provided with a spring member 116 or other biasing component or element (e.g., a resilient portion of the blade carrier 110 extending proximally from the substantially flat surface 113). A connector element 118 (e.g., a post) traverses the guide channel 114 connecting (or otherwise securing or coupling together) the blade activation button 112 and the spring member 116 at opposite sides of the guide channel 114. A bearing portion 120 of the connector element 118, biased by the spring member 116, detents outwardly to engage with the various blade carrier position setting portions (i.e., the wider portions) of the guide channel 114. In this example embodiment, and referring additionally to FIGS. 5 and 6, the blade carrier position setting portions, starting at the proximal end of the guide channel 114 and moving toward its distal end, facilitate securing the blade carrier 110 in a "safe" position (in which the blade 111 is fully retracted within the housing portion 102), first and second "top cut" blade extension positions, and first and second "tray cut" blade extension positions, respectively. In FIG. 6, the blade activation button 112 is shown repositioning (as denoted by arrow 122) along the guide channel 114 from the second "top cut" position to the first "tray cut" position.

The blade 111 is activated by depressing the blade activation button 112 and sliding the index forward to reposition the blade carrier 110 forward (or distally) along the channel 109 (of the channel/guard structure 108). The spring member 116 (e.g., a flexible arm on the blade carrier 110) pushes the blade activation button 112 up into cutouts in the guide channel 114. In this example embodiment, there are six depth settings in total: safe, two top cut positions, two tray cut positions, and also (as discussed below) a blade change position.

Example embodiments of cutters (or cutter apparatuses) include multiple guards at least two of which are fixed in position in relation to each other. In example embodiments, the multiple guards include two guards positioned at opposite sides of the cutter (or cutter housing). One or more of the multiple guards can be provided on, secured to, or integrally formed as part of the channel/guard structure 108.

In example embodiments, the multiple guards include at least two guards that are fixed in position in relation to a distal portion of the cutter. For example, one or more of the guards can be secured to the distal portion in a manner that prevents or discourages or at least does not readily facilitate removal or separation of the guard(s) from the distal portion by a user of the cutter. The multiple guards can additionally, or alternatively, include one or more guards that are detachable.

In example embodiments, a cutter (or cutter apparatus) includes guards that are mirror images of each other (e.g., symmetrical in relation to each other and also in relation to a distal portion of the cutter). In this example embodiment, the channel/guard structure 108 includes or is provided with two guards 130*a* and 130*b* that are mirror images of each other. The guards can be coupled together by a common component or element of the cutter. The guards 130*a* and 130*b* can be, for example, integrally formed with an actuator guide portion 132 (of channel/guard structure 108) that includes and/or defines the guide channel 114. In example embodiments, the multiple guards are one or more of directly coupled (e.g., in direct contact with each other), indirectly coupled (e.g., coupled together by one or more intermediary coupling elements or components), continuously coupled (e.g., at all times and/or by a continuous coupling structure or mechanism), and intermittently coupled (e.g., when one or more of the guards is detachable).

Thus, in an example embodiment, a cutter apparatus includes a housing, a blade holder coupled to the housing, and multiple guards coupled to the housing, at least two of the guards being fixed in position in relation to each other and/or in relation to a distal portion of the housing. In example embodiments, the blade holder includes a blade carrier coupled to and repositionable in relation to the housing. Although example embodiments of cutters (or cutter apparatuses) described herein include a blade carrier (or blade holder) that is configured to be repositionable (e.g., in relation to the cutter housing), the scope of the present invention(s) additionally includes and/or contemplates cutters (or cutter apparatuses) with a blade holder that is coupled to the housing, but not repositionable (e.g., a fixed blade).

Example embodiments of cutters (or cutter apparatuses) include a blade carrier (or other component or element of the cutter) that is repositionable in relation to a portion of the cutter and multiple safety actuators configured to facilitate an action or process of disengaging one or more interlocks that prevent the blade carrier (or other component or element of the cutter) from being repositioned (e.g., for a blade change operation). The multiple (e.g., two or more independently repositionable) safety actuators can be configured to disengage the one or more interlocks, for example, when a plurality of the safety actuators are activated (e.g., two or more, or all of the safety actuator, are simultaneously in an activated state).

Figure 7:
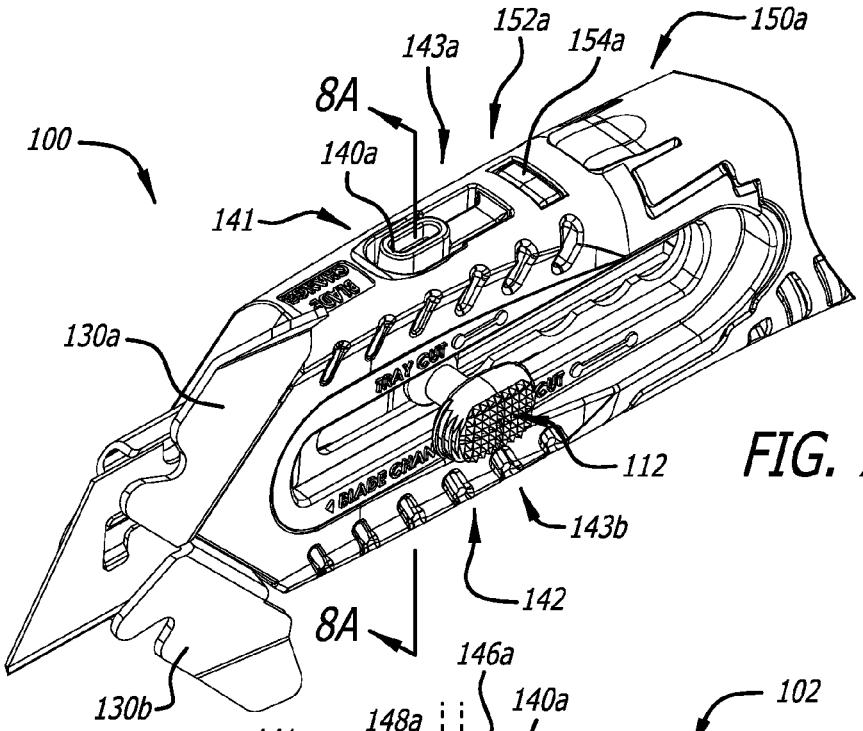
FIG. 7 is a partial perspective view of the cutter apparatus of FIG. 1 in which the blade carrier and its blade activation button are positioned along the guide channel at a distal-most tray cut position.
Figure 8A:
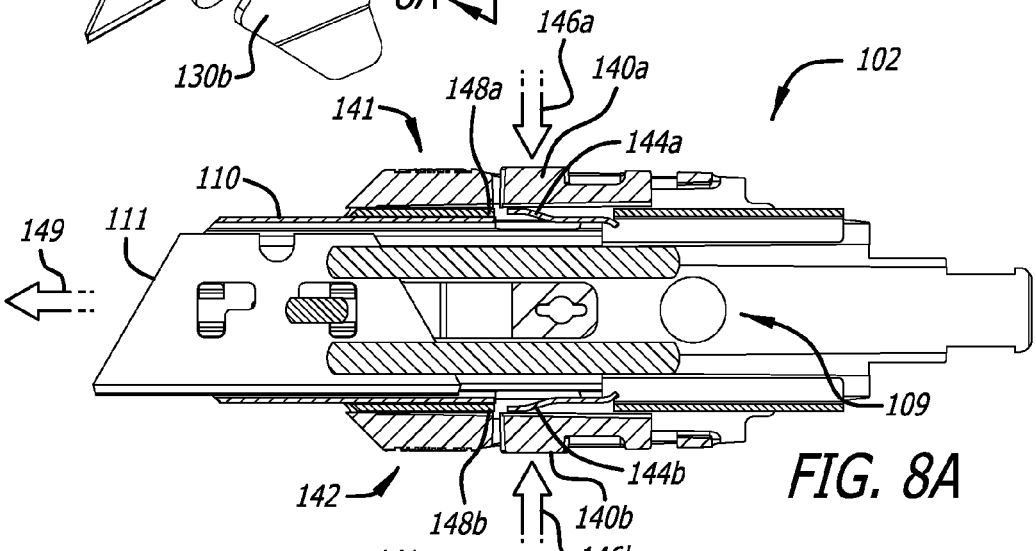
FIG. 8A is a cross-sectional view of the cutter apparatus along lines 8A-8A of FIG. 7 showing dual safety actuators that are repositionable for disengaging interlocks that prevent the blade carrier from being repositioned (extended) to a blade change position.

The safety actuators can include, by way of example, dual actuators configured to function as a Boolean AND operator, i.e., requiring both actuators to be activated in order to release the blade carrier or other component or element of the cutter. Referring to FIGS. 6, 7, and 8A, in this example embodiment, the cutter apparatus 100 includes safety actuators 140*a* and 140*b* located at the top side 141 and the bottom side 142, respectively, of the housing portion 102. The safety actuators 140*a* and 140*b* are located within recesses 143*a* and 143*b*, respectively, in the housing portion 102 (e.g., substantially flush with adjacent exterior surfaces of the housing when not activated). The safety actuators 140*a* and 140*b* can include or be provided in the form of flexible components (e.g., levers coupled or secured to or integrally formed with the housing portion 102) configured to be repositionable in relation to the one or more interlocks. The safety actuators 140*a* and 140*b* can include or be provided in the form of inflexible, rigid, or partially flexible or resilient components as well as articulated components and associated interconnection mechanisms and devices.

Figure 8B:
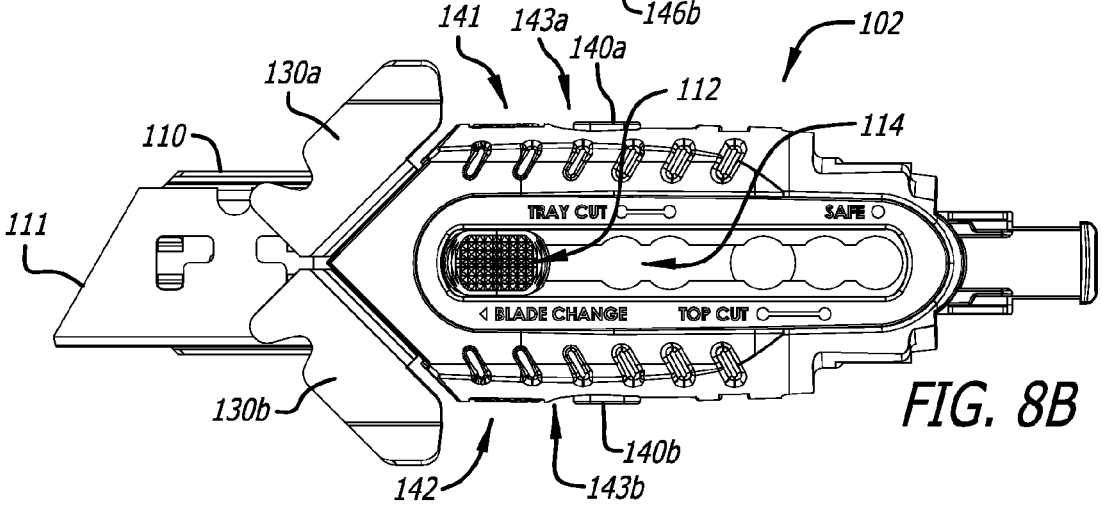
FIG. 8B is a side view of the housing portion of the cutter apparatus of FIG. 1 showing the blade carrier extended from the housing portion to the blade change position.

In example embodiments, the safety actuators are biased to reposition away from the one or more interlocks (the biasing forces being imparted, for example, by the actuators themselves and/or by one or more other components or elements of the cutter). In example embodiments, the one or more interlocks include portions configured to reposition (to respective blade carrier release positions) in response to activation of the safety actuators. Referring to FIGS. 4, 4A, 4B, and 8A, in this example embodiment, the blade carrier 110 includes engagement elements 144*a* and 144*b* (e.g., springs coupled or secured to or integrally formed with the blade carrier 110)

configured to be repositionable (e.g., in relation to surfaces or portions of the channel 109) in response to activation of the safety actuators as denoted by arrows 146*a* and 146*b*, respectively. The engagement elements 144*a* and 144*b* reposition inwardly (e.g., flexing laterally in relation to the housing portion 102), disengaging from cutouts 148*a* and 148*b* (of the channel 109), respectively. When both of the safety actuators 140*a* and 140*b* are activated (depressed), the blade carrier 110 is free to be repositioned (extended distally) as denoted by arrow 149 to its blade change position (e.g., a distal-most or fully extended position, as illustrated in FIG. 8B, at which the blade activation button 112 is prevented from further forward movement due to its connector element 118 contacting the distal end of the guide channel 114). If either of the safety actuators 140*a* and 140*b* is not activated (depressed), its corresponding engagement element interlocks with a cutout in the channel thereby preventing the user from accidentally putting the cutter in the blade change position. After the cutter is in the blade change position, the blade 111 can be easily removed and replaced.

The multiple safety actuators can include dual blade change levers and/or other repositionable components or elements. In example embodiments, the multiple safety actuators include dual actuators that are symmetrical (e.g., in relation to each other and also in relation to a distal portion of the cutter), positioned at opposite sides of the cutter housing, and/or are configured to activate when repositioned toward each other. The safety actuators can be, but are not necessarily, included or provided as part of the housing.

Thus, in an example embodiment, a cutter apparatus includes a housing, a blade carrier coupled to the housing and repositionable in relation to the housing, and multiple safety actuators configured to disengage, when a plurality of the safety actuators are activated, one or more interlocks that prevent the blade carrier from being repositioned for a blade change operation.

Figure 3:
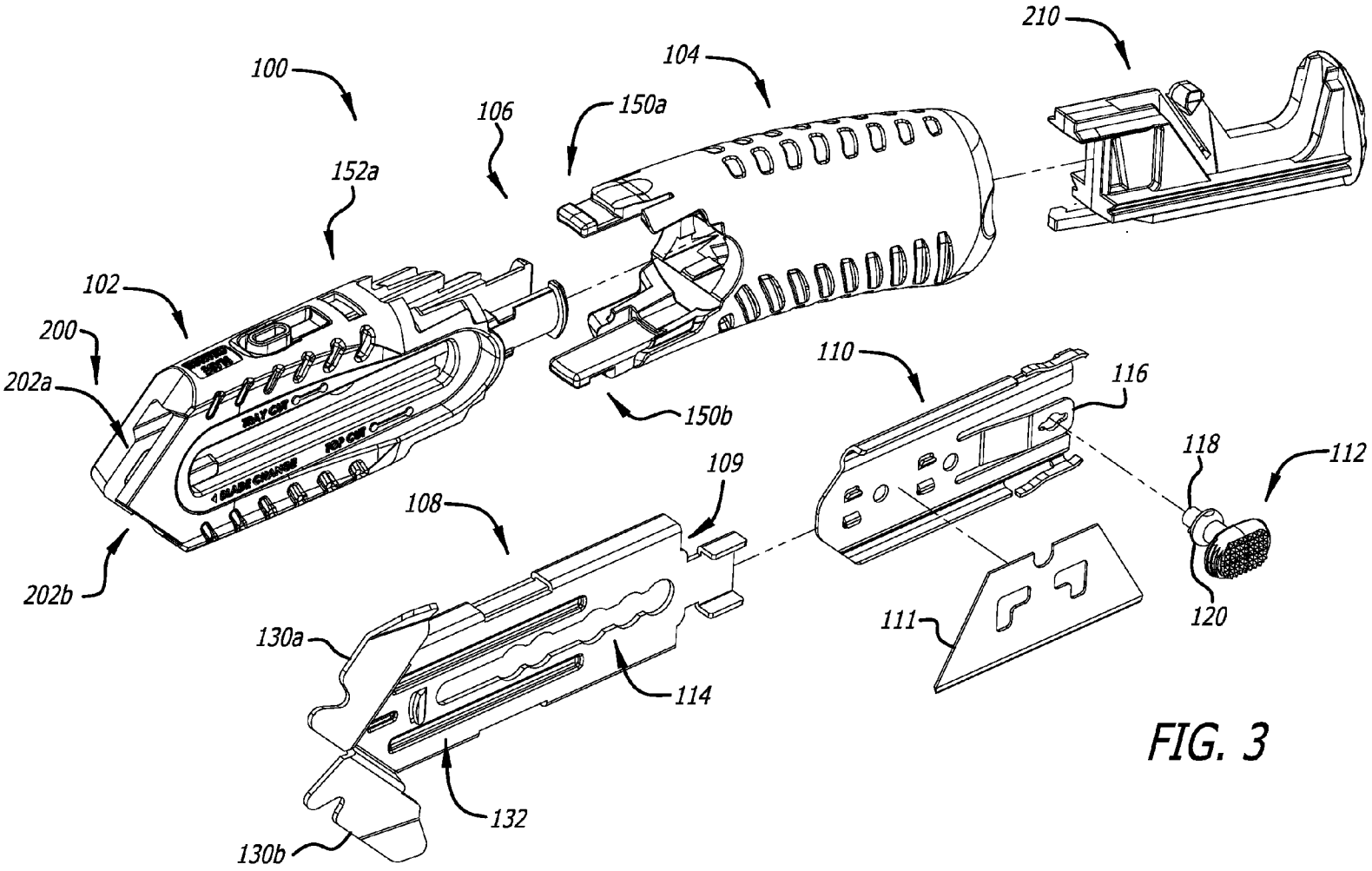
FIG. 3 is an exploded perspective view of the cutter apparatus of FIG. 1.

Example embodiments of cutters (or cutter apparatuses) include a mechanism or device that facilitates ambidextrous (left- and right-handed) operation of the cutter. The mechanism or device can include one or more engagement interfaces, for example, an exterior interface and an interior interface. Referring to FIGS. 3, 6, and 7, in this example embodiment, the handle portion 104 includes symmetrical dual latches 150*a* and 150*b* (e.g., flexible members provided at opposite sides of the distal end of the handle portion 104) and the housing portion 102 includes symmetrical openings 152*a* and 152*b* (e.g., provided as shown at opposite sides of the housing portion 102). In this example embodiment, the openings 152*a* and 152*b* are formed or otherwise provided at the top side 141 and the bottom side 142, respectively. The latches 150*a* and 150*b* are received within the openings 152*a* and 152*b*, respectively, to secure the housing portion 102 and the handle portion 104 together when they are interfitted in either a left-handed configuration or a right-handed configuration. The latches 150*a* and 150*b* respectively include tabs 154*a* or 154*b* (or other protruding portions or structures) that are configured to engage side portions of the openings when the housing and the handle are secured together. In this example embodiment, the tabs 154*a* and 154*b* must both be depressed (pressed inward) in order to unlock the housing and handle portions.

Figure 9:
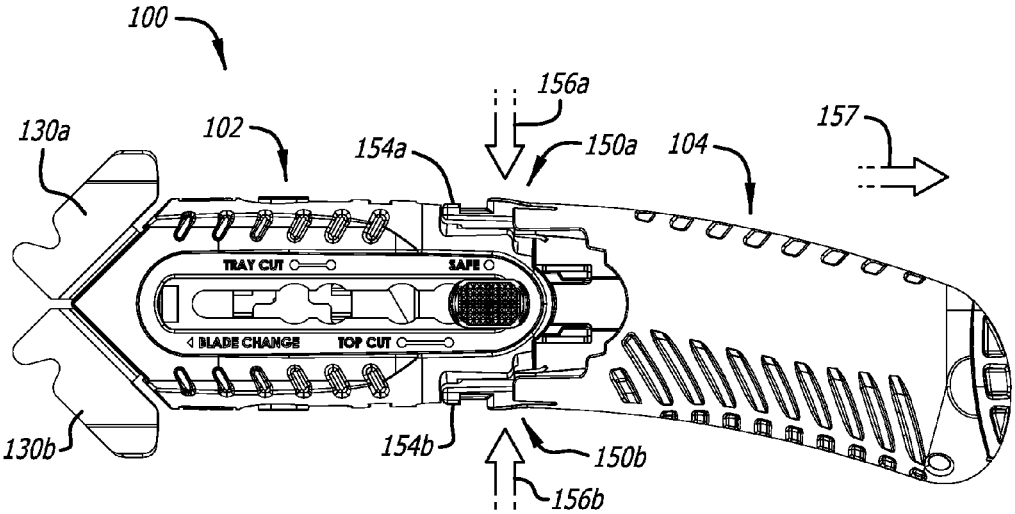
FIG. 9 is a side view of the cutter apparatus of FIG. 1 showing the handle portion disengaged from the housing portion, at an exterior interface defined therebetween, and repositioned sufficiently apart from the housing portion, at an interior interface defined therebetween, such that the handle and housing portions are rotatably repositionable in relation to each other for reconfiguring the cutter apparatus.

Example embodiments of cutters (or cutter apparatuses) include a housing portion (e.g., a distal portion) and a handle portion (e.g., a proximal portion) that are symmetrical about a first plane and a second plane, respectively. In example embodiments, the first and second planes are orthogonal. Referring to FIG. 9, in this example embodiment, a front body portion (e.g., front half) of the cutter apparatus 100 is symmetrical about (in relation to) an XZ plane (e.g., passing through the housing portion 102 and intersecting a point between the guards 130*a* and 130*b*) and a rear body portion (e.g., rear half) of the cutter apparatus 100 is symmetrical about (in relation to) an XY plane (e.g., passing through the handle portion 104 and intersecting a center point between left and right sides thereof). In conjunction with the blade carrier 110, which allows the blade 111 to be selectively positioned in one of a pair of cutting edge orientations that are mirror images of each other, use the cutter apparatus 100 during a cutting operation utilizing left- and right-handed cutter apparatus configurations as described herein will be identical for left- and right-handed users, respectively.

Thus, in an example embodiment, a cutter apparatus includes a housing, configured for holding a blade, and a handle coupled to the housing via an engagement interface configured to allow a user of the cutter apparatus to selectively interfit together the housing and the handle in multiple different cutter apparatus configurations including a pair of configurations accommodating left and right-handed operation of the cutter apparatus, respectively.

Example embodiments of cutters (or cutter apparatuses) include an engagement interface configured to facilitate selectively interfitting together portions of the cutter in multiple different ergonomic configurations (e.g., in relation to gripping the cutter by hand). The engagement interface can include or be defined, for example, by complementary surfaces (or other portions) of the housing and the handle, respectively. In example embodiments, the engagement interface is configured to permit the handle (e.g., upon release) to be rotatably repositioned in relation to the housing, or vice versa. In example embodiments, the engagement interface includes an exterior (e.g., peripheral) interface configured to automatically lock (or secure) the housing and the handle together when the housing and the handle are repositioned to interfit together in one (any) of the cutter apparatus configurations. In example embodiments, the exterior interface is configured to allow a user of the cutter apparatus to unlock (or disengage) the housing and the handle by actuating multiple release devices provided on one or more of the housing and the handle.

Figure 10:
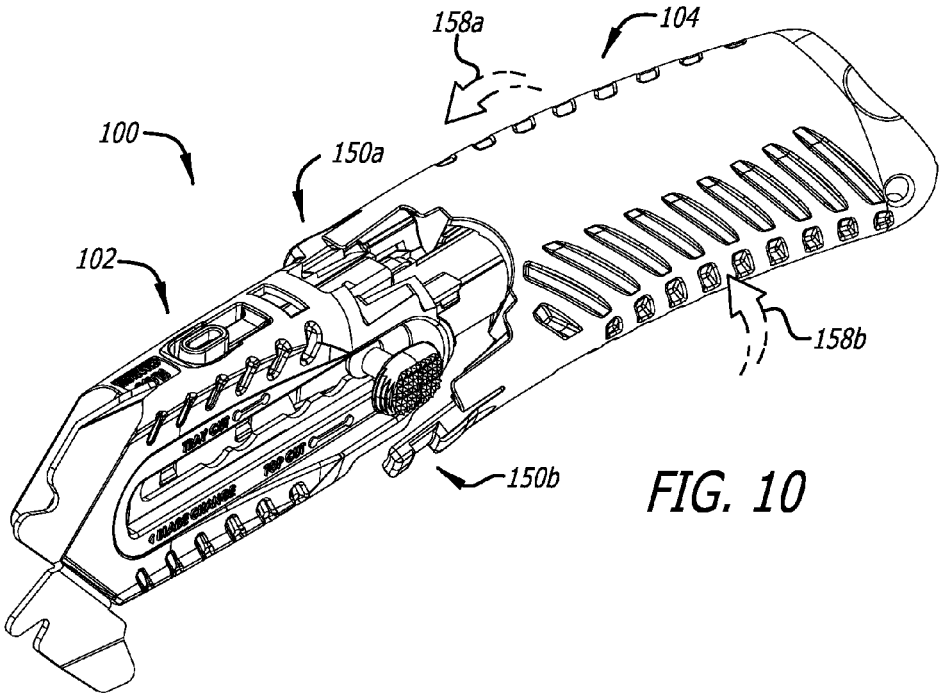
FIG. 10 is a perspective view of the cutter apparatus of FIG. 1 showing the handle portion being rotatably repositioned in relation to the housing portion.
Figure 11:
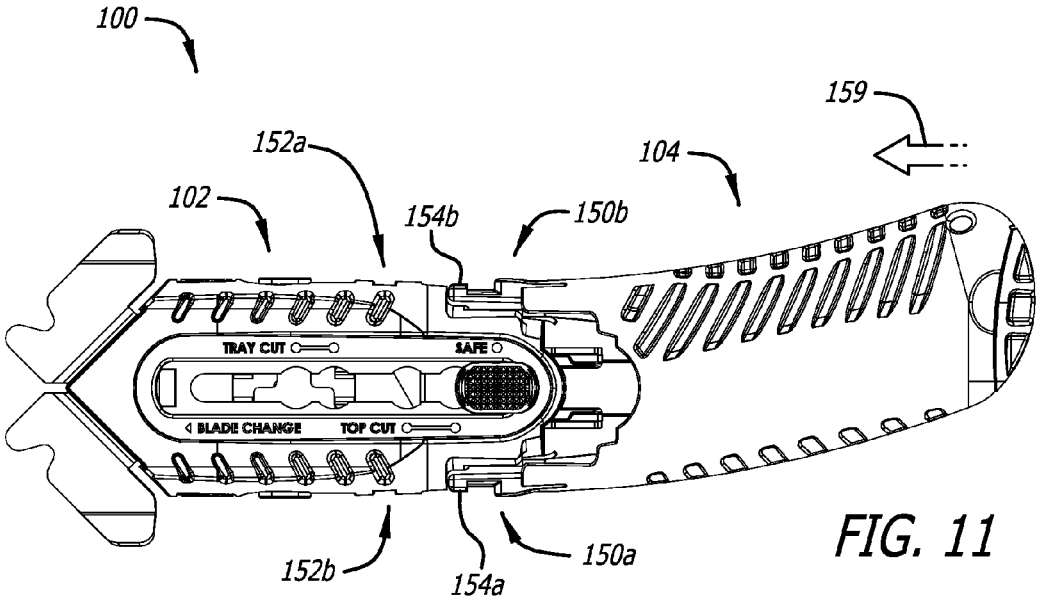
FIG. 11 is a side view of the cutter apparatus of FIG. 1 showing the handle portion repositioned in relation to and aligned for reengagement with the housing portion in a different cutter apparatus configuration.
Figure 12:
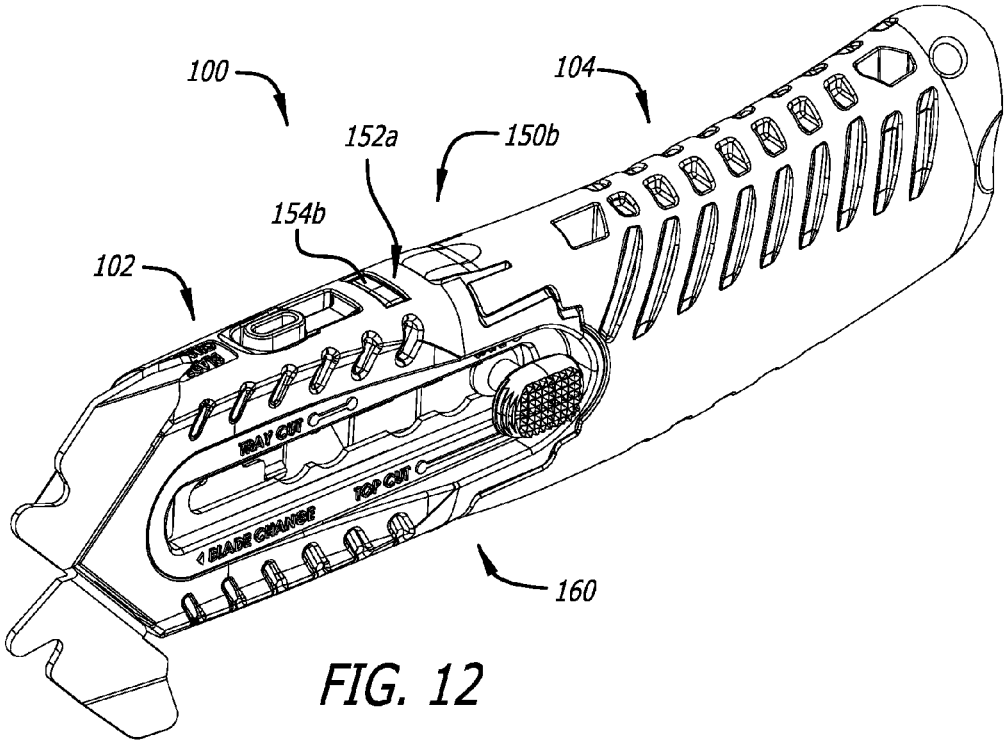
FIG. 12 is a perspective view of the cutter apparatus of FIG. 1 in which the handle portion has been repositioned in relation to and reengaged with the housing portion providing symmetrical cutter apparatus configuration.

Referring to FIG. 9, in this example embodiment, the cutter apparatus 100 is reconfigurable for use by left- or right-handed users by depressing the tabs 154*a* and 154*b* (of the handle portion 104) as denoted by arrows 156*a* and 156*b*, respectively, and sliding the handle portion 104 back as denoted by arrow 157. Referring to FIG. 10, with the handle portion 104 disengaged from the housing portion 102 and repositioned sufficiently apart from the housing portion 102, the handle and housing portions can now be rotatably repositioned in relation to each other, e.g., as shown by arrows 158*a* and 158*b*, for reconfiguring the cutter apparatus. Referring to FIG. 11, once the handle portion 104 is repositioned in relation to and aligned for reengagement with the housing portion 102 in a different cutter apparatus configuration, the handle portion 104 can be slid forward again as indicated by arrow 159. Referring to FIG. 12, the handle portion 104 is shown repositioned in relation to and reengaged with the housing portion 102 providing a cutter apparatus configuration that is symmetrical to the configuration shown in FIG. 1. An exterior interface 160 is provided (or defined), for example, by the symmetrical dual latches 150*a* and 150*b* (of the handle portion 104) and the symmetrical openings 152*a* and 152*b* (of the housing portion 102).

Thus, in an example embodiment, a cutter apparatus includes a housing with a blade carrier configured for holding a blade in multiple different cutting edge (or blade) orientations in relation to the housing, the cutting edge orientations including a pair of cutting edge orientations that are mirror images of each other, and a handle coupled to the housing via an engagement interface configured to allow a user of the cutter apparatus to selectively interfit (or connect) together the housing and the handle in multiple different cutter apparatus configurations including a pair of configurations (e.g., predetermined configurations) which, in conjunction with cutting edge orientations respectively selected from the pair of mirror image cutting edge orientations, accommodate ambidextrous operation of the cutter apparatus.

The engagement interface can be configured to allow the housing and the handle to interfit in multiple different predetermined configurations (e.g., two or more predetermined configurations) and/or only in predetermined configurations (e.g., configurations defined or rendered permissible by components or structures of the engagement interface). The engagement interface can be configured to allow the housing and the handle to interfit in multiple different symmetrical configurations (e.g., two or more symmetrical configurations) and/or only in symmetrical configurations (e.g., configurations that are symmetrical in relation to each other, symmetrical in their spacing, and/or symmetrical in relation to a point or location on the cutter.

Example embodiments of cutters (or cutter apparatuses) include an engagement interface with an inner (or central) portion and an outer (or peripheral) portion. In example embodiments, the engagement interface includes an interior interface (e.g., a central interface within the cutter apparatus) configured to couple (e.g., slidably and rotatably couple) the housing and the handle together. In example embodiments, a cutter apparatus includes a housing portion, a handle portion, and an interior interface defined therebetween such that the handle and housing portions are rotatably repositionable in relation to each other for reconfiguring the cutter apparatus. In example embodiments, the engagement interface includes a coupler configured to permit the handle to be rotatably repositioned in relation to the housing. The coupler includes, for example, a channel and a bearing (e.g., included as part of or provided on the handle and the housing, respectively, or vice versa). The bearing is secured or fitted (e.g., snapped-fitted) within and repositionable in relation to (e.g., along) the channel.

Referring to FIGS. 13, 13A, 14, 14A, and 14B, in this example embodiment, the housing and handle portions 102 and 104 include a bearing 162 and a channel 164, respectively. The bearing 162 is installed (e.g., snap-fitted) into the channel 164 and includes one or more engagement surfaces (or portions) configured to be repositionable in relation to the channel 164 (e.g., along and pivotally within the channel). In this example embodiment, the bearing 162 is slidably coupled with the channel 164. An interior interface 170 is provided (or defined), for example, by the bearing 162 (of the housing portion 102) and the channel 164 (of the handle portion 104).

Figure 13:
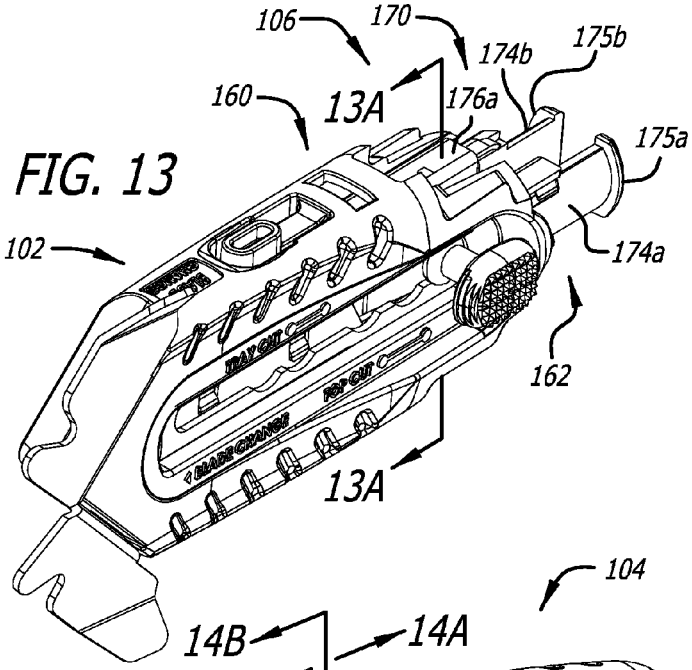
FIG. 13 is a perspective view of the housing portion of the cutter apparatus of FIG. 1.
Figure 13A:
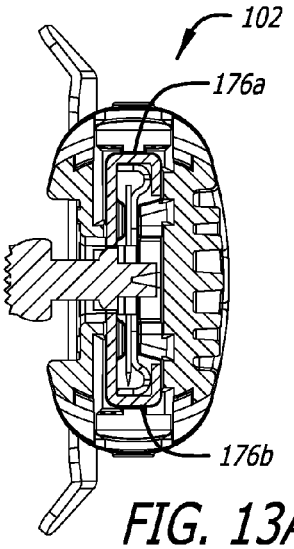
FIG. 13A is a cross-sectional view of the housing portion along lines 13A-13A of FIG. 13.
Figure 14:
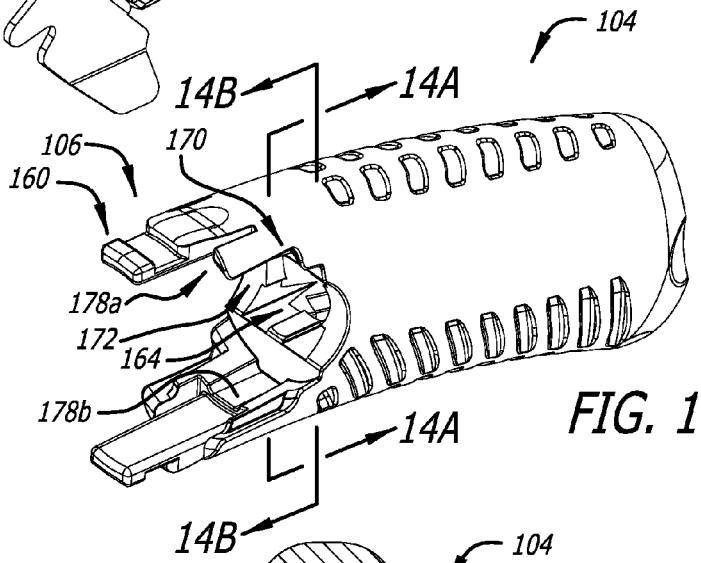
FIG. 14 is a perspective view of the handle portion of the cutter apparatus of FIG. 1.
Figure 14A:
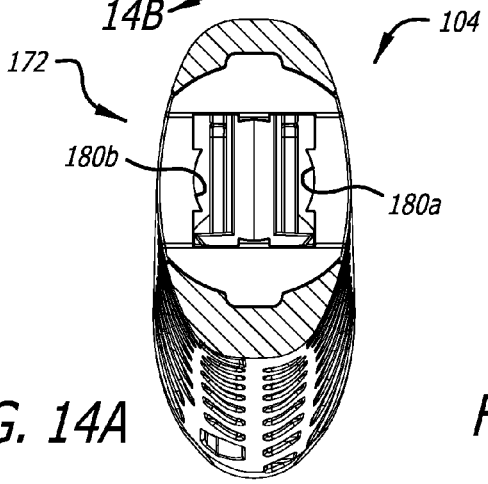
FIG. 14A is a cross-sectional view of the housing portion along lines 14A-14A of FIG. 14.
Figure 14B:
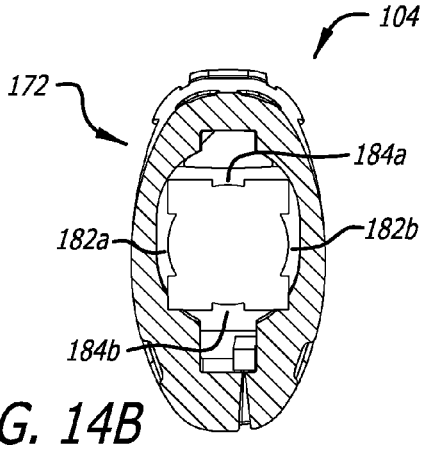
FIG. 14B is a cross-sectional view of the housing portion along lines 14B-14B of FIG. 14.

Example embodiments of cutters (or cutter apparatuses) include a mechanism or device that facilitates multiple different engagement configurations at which housing and handle portions of the cutter are secured together and, when the portions are not in one of the engagement configurations, maintains a coupling arrangement as between the housing and handle portions. To this end, the channel 164 (e.g., a cylindrical channel or bore) includes or is provided with an inwardly extending annular ridge or ridge structure 172, and the bearing 162 includes or is provided with dual symmetrical flexible members 174*a* and 174*b* with laterally extending end portions 175*a* and 175*b*, respectively, that are fitted into and secured within the channel 164. Referring to FIGS. 13A and 14, the housing portion 102 includes symmetrical raised portions 176*a* and 176*b*, and the handle portion 104 includes complementary recessed portions 178*a* and 178*b* . Referring to FIG. 14A, the ridge structure 172 includes or is provided with ridge portions 180*a* and 180*b* (e.g., as shown). The bearing 162 is installed in the channel 164 by pressing its flexible members 174*a* and 174*b* inward a sufficient amount to allow their respective laterally extending end portions 175*a* and 175*b* to reposition past the ridge portions 180*a* and 180*b* (of the ridge structure 172) and into the channel 164. With the symmetrical raised portions 176*a* and 176*b* aligned with the recessed portions 178*a* and 178*b*, respectively, or aligned with the recessed portions 178*b* and 178*a* , respectively, the handle portion 104 can be slid forward to engage with the housing portion 102 in the selected cutter apparatus configuration. The ridge structure 172 and the bearing 162 are configured such that the ridge structure 172 prevents the laterally extending end portions 175*a* and 175*b* (of the bearing 162) from exiting the channel 164 once the bearing 162 is snap-fitted into or otherwise installed in the channel 164. Referring to FIG. 14B, the ridge structure 172 includes or is provided with ridge portions 182*a*, 182*b*, 184*a*, and 184*b* (e.g., spaced as shown) that engage with the laterally extending end portions 175*a* and 175*b* when the bearing 162 is installed (and its flexible members 174*a* and 174*b* no longer compressed) preventing the laterally extending end portions 175*a* and 175*b* from being withdrawn from the channel 164. With the complementary portions of the exterior interface 160 disengaged, the housing portion 102 and the handle portion 104 remain coupled together and are repositionable (in this example, both longitudinally and rotationally) in relation to each other.

Thus, in an example embodiment, a cutter apparatus includes a housing with a blade carrier, and a handle coupled to and repositionable in relation to the housing to multiple different engagement positions at which the housing and the handle are secured together, the housing and the handle being configured such that when not secured together the housing and the handle remain coupled together and are repositionable in relation to each other. In example embodiments, the housing and the handle are repositionable further apart from each other (e.g., when portions of an engagement interface therebetween are disengaged) and a portion of the housing (e.g., a bearing or other coupling component or structure) is slidably coupled with a recessed or other complementary portion of the handle. In example embodiments, the housing and the handle are configured to permit rotation of the handle (about an axis) in relation to the housing, or vice versa, when the housing and the handle are not secured together. In example embodiments, the housing and the handle are one or more of directly coupled (e.g., in direct contact with each other), indirectly coupled (e.g., coupled together by one or more intermediary coupling elements or components), continuously coupled (e.g., at all times and/or by a continuous coupling structure or mechanism), and intermittently coupled (e.g., when elements or components providing or defining an engagement interface are repositionable in relation to each other).

Figure 19:
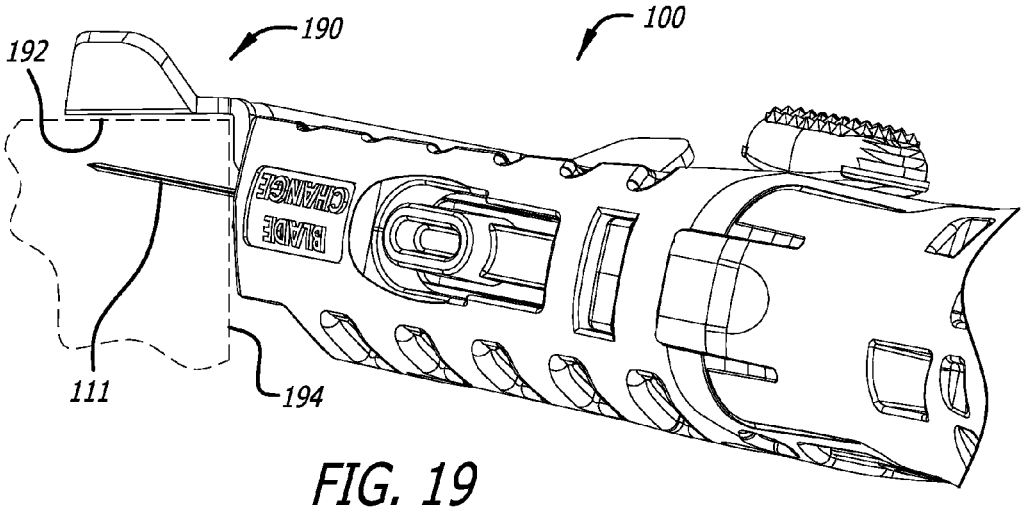
FIG. 19 is a partial perspective view of the cutter apparatus of FIG. 1 showing a blade extended from the cutter apparatus and a contact portion of a guard brought into contact with a workpiece during a cutting operation.

Example embodiments of cutters (or cutter apparatuses) include a guard (or guard structure) with multiple workpiece contact portions that are associated (e.g., mutually exclusively) with multiple different cutter configurations, respectively. Referring to FIG. 19, in this cutter apparatus configuration, the blade 111 is extended from the cutter apparatus 100, and a contact portion 192 of a guard 190 brought into contact with a workpiece 194 during a cutting operation. The guard 190 includes multiple contact portions, for example, symmetrical contact portions such as those provided by guards 130*a* and 130*b*.

Thus, in an example embodiment, a cutter apparatus includes a housing configured for gripping by a hand, a blade holder and/or blade coupled to the housing, a guard (or guide) secured (e.g., fixedly secured) to the housing, and a handle coupled to the housing via an engagement interface configured to allow a user of the cutter apparatus to selectively interfit together the housing and the handle in multiple different cutter apparatus configurations including a pair of configurations in which the guard, in relation to each configuration, faces the blade from right and left sides, respectively, of the cutter apparatus. In example embodiments, the guard includes multiple workpiece contact portions (mutually exclusively) associated with the multiple different cutter apparatus configurations, respectively. In example embodiments, the housing and the handle are tool-lessly reconfigurable.

In example embodiments, a cutter (or cutter apparatus) is reconfigurable (e.g., in relation to a gripping interface, surface, or structure) in multiple different cutter configurations and includes multiple cut guards (or cut guides) positioned for contact with a workpiece depending upon the cutter configuration. In example embodiments, at least one of the multiple cut guards is positioned for contact with a workpiece for each of the configurations. In example embodiments, a different cut guard is positioned for contact with a workpiece for each of the configurations.

One or more of the guards is configured, for example, such that the cutter can be slid along the top of a box, allowing the top of the box to be removed more easily and safely with less risk of damage to merchandise inside. A guard on either side of the knife, as described herein, facilitates ambidextrous operation.

Figure 2A:
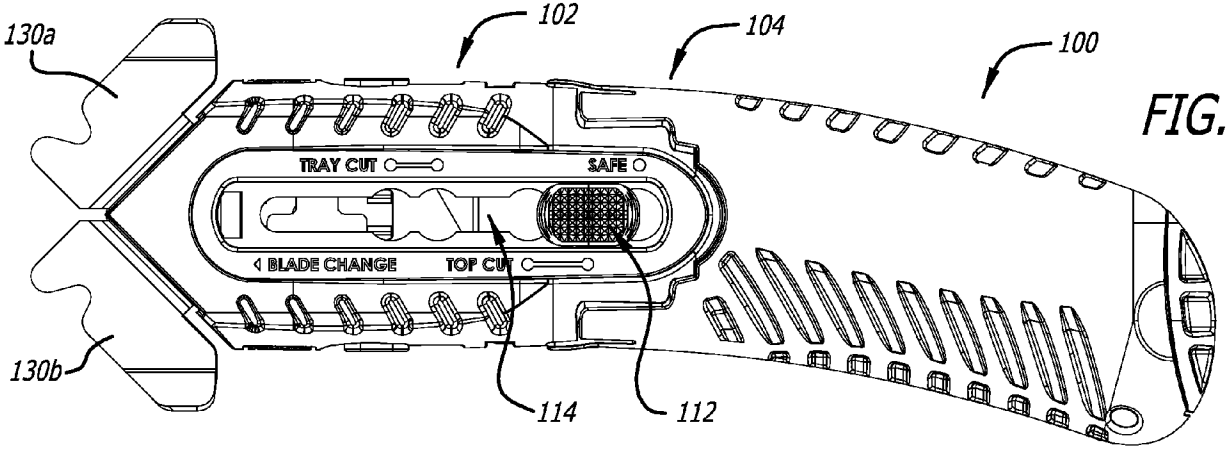
FIGS. 2A and 2B are left and right sides views, respectively, of the cutter apparatus of FIG. 1.
Figure 2B:
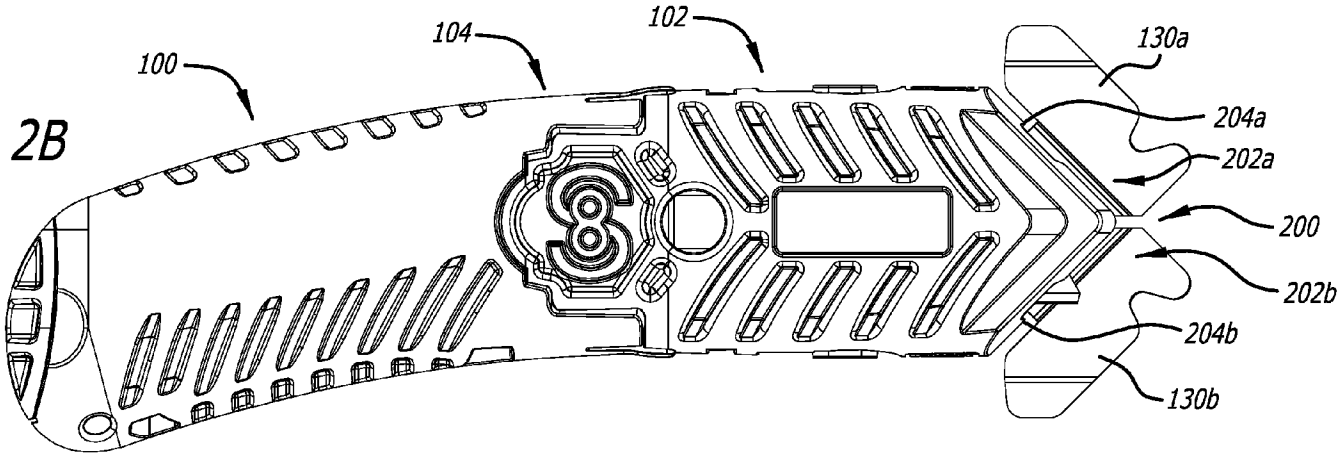

Referring to FIGS. 2A and 3, in this example embodiment, the housing portion (or distal portion) 102 includes or is provided with an opening 200 at least partially defined by surfaces (or other portions) of the housing (e.g., symmetrical surfaces) that face different directions, respectively. In this example embodiment, distal end portions 202*a* and 202*b* form or provide a V-shaped end portion of the housing (e.g. as shown). In this example embodiment, the cut guards 130*a* and 130*b* (mirror images of each other) are positioned adjacent to the distal end portions 202*a* and 202*b*, respectively.

Thus, in an example embodiment, a cutter apparatus includes a distal portion including a housing with an opening, a blade carrier coupled to and repositionable in relation to the housing, and multiple cut guards (or cut guides), and a proximal portion coupled to the distal portion such that the portions are repositionable in relation to and interfit with each other in multiple different configurations in which the portions are secured together and a different cut guard is positioned for contact with a workpiece for each of the configurations.

In example embodiments, the distal portion is or includes a guide for an actuator/slider configured for repositioning the blade carrier. The cutter apparatus can include, for example, an actuator (e.g., a slider) coupled to the housing and configured to allow a user of the cutter apparatus to reposition the blade carrier, and an actuator guide (e.g., a slider guide) secured to the housing. One or more of the cut guards and the actuator guide can be, but are not necessarily, integrally formed.

In example embodiments, the opening is defined at least in part by a two (symmetrical) end portions (e.g., substantially flat/planar surfaces) of the housing that face the opposing guards, respectively.

In example embodiments, the cut guards are fixedly positioned (e.g., secured together) in relation to each other (and in relation to the housing). The multiple cut guards include, for example, two cut guards positioned at opposite sides (or portions) of the housing. In this example embodiment, the cut guards 130*a* and 130*b* are positioned adjacent to opposite ends 204*a* and 204*b*, respectively, of the opening 200.

The proximal portion includes, for example, a handle with a bottom side (e.g., with a curved ergonomic shape configured to be held by the inside of the user's fingers opposite the knuckles during a cutting operation) and, for each of the configurations, one of the cut guards is positioned adjacent to a side (or portion) of the housing that is contiguous and/or in alignment with the bottom side of the handle and the other guard is positioned adjacent to a top side of the cutter apparatus.

Figure 20:
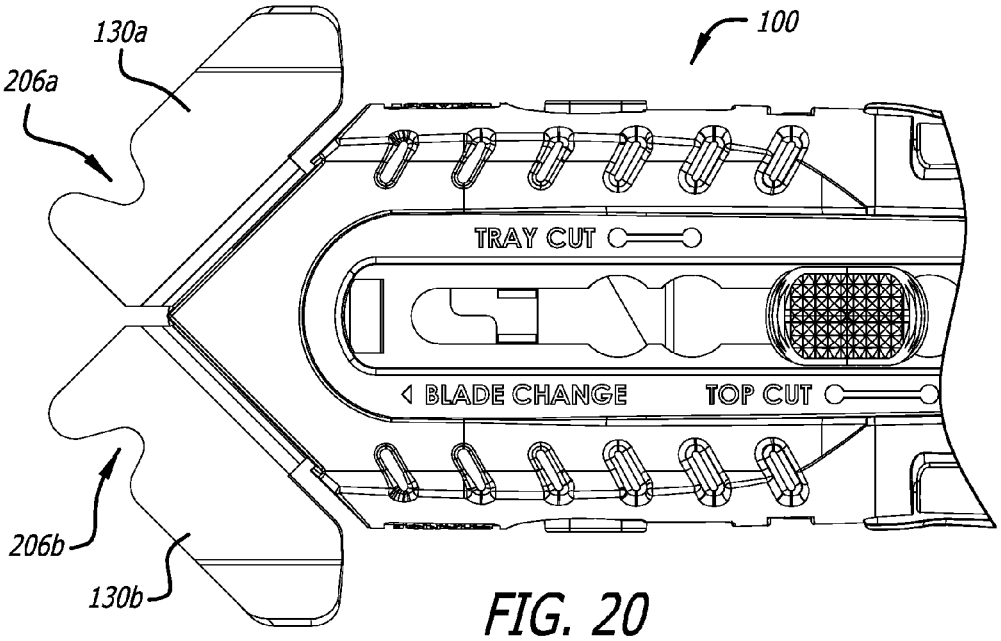
FIG. 20 is a partial side view of the cutter apparatus of FIG. 1 showing opposing cut guards of the guard structure and their respective recessed portions.

One or more of the cut guards (e.g., all of the cut guards) can include a recessed portion (i.e., a tape splitter) that faces the workpiece when the cut guard is in a configuration in which it is positioned for contact with the workpiece. A tape splitter formed into each guard allows taped boxes to be opened without exposing the blade, reducing the risk of accidental cuts. Referring to FIG. 20, in this example embodiment, the cut guards 130*a* and 130*b* include or are provided with recessed portions 206*a* and 206*b* (e.g., contoured as shown), respectively.

In example embodiments, a cutter apparatus includes a housing, a blade holder coupled to the housing, and multiple guards coupled to the housing, at least two of the guards being fixed in position in relation to each other and/or in relation to a distal portion of the housing, the housing including distal and proximal portions that are repositionable in relation to each other in multiple different configurations in which the portions are secured together and a different guard is positioned for contact with a workpiece for each of the configurations. In example embodiments, for each of the configurations, one of the guards is positioned adjacent to a side of the housing that is adjacent to a bottom side of the cutter apparatus. In example embodiments, at least one of the guards includes a recessed portion that faces the workpiece when the guard is in a configuration in which the guard is positioned for contact with the workpiece.

Example embodiments of cutters (or cutter apparatuses) include a mechanism or device that facilitates rotatable repositioning of a blade storage assembly about an axis that is parallel or substantially parallel to a longitudinal axis associated with a blade holder and/or a blade of the cutter. Referring to FIGS. 15, 16A, 16B, 17A, 17B, 18A, and 18B, in this example embodiment, the cutter apparatus 100 includes a blade storage assembly 210 that is repositioned in relation to the handle portion 104 for gaining access to a spare blade holder 212 (of the assembly 210). In this example embodiment, the blade storage assembly 210 is coupled (e.g., slidably coupled) to the handle portion 104.

Figure 15:
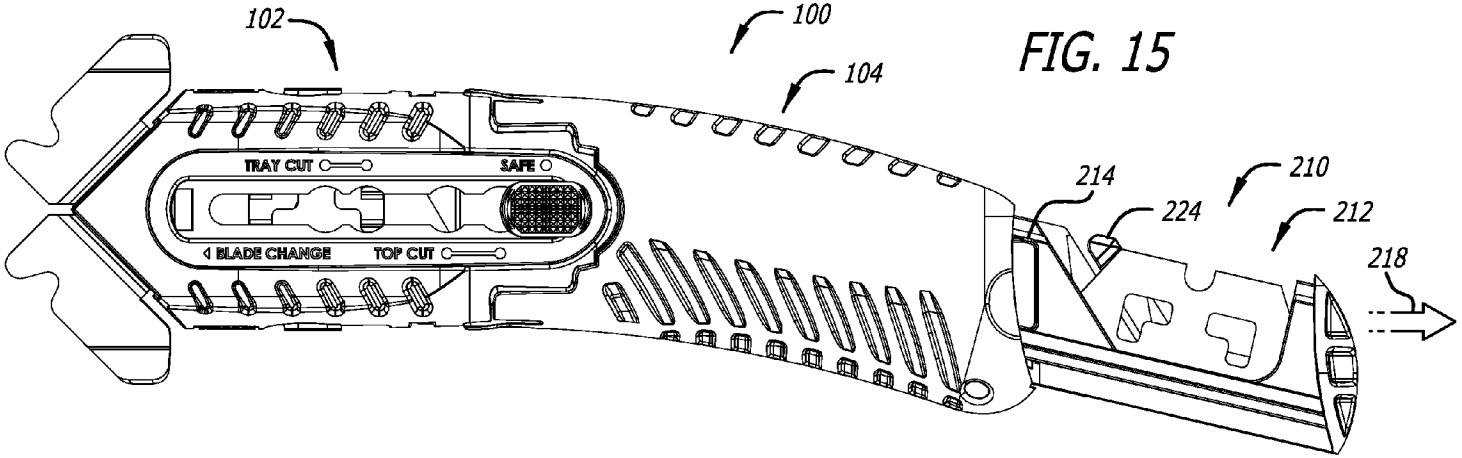
FIG. 15 is a side view of the cutter apparatus of FIG. 1 showing the blade storage assembly repositioned in relation to the handle portion for gaining access to the spare blade holder of the assembly.

The blade storage assembly 210 includes or is provided with upper rails 214*a* and 214*b* and lower rails 216*a* and 216*b* that interface with complementary portions or structures of the handle portion 104, allowing the blade storage assembly 210 to be slidably withdrawn from the base of the handle as denoted by arrow 218 (FIG. 15). By way of example, the blade storage assembly 210 is coupled to the handle portion 104 with a friction fit (e.g., of sufficient strength to steady the assembly in position and/or resist slight forces imparted, perhaps inadvertently, by a user of the cutter apparatus).

Thus, in an example embodiment, a cutter apparatus includes a housing configured for gripping by a hand, a blade holder and/or a blade coupled to the housing, and a blade storage assembly that is coupled to the housing and rotatably repositionable about an axis parallel or substantially parallel to a longitudinal axis associated with the blade holder and/or the blade. The blade holder and/or the blade can be, for example, slidably supported within the housing and repositionable along the longitudinal axis.

Example embodiments of cutters (or cutter apparatuses) include a blade storage compartment coupled to and repositionable in relation to a portion of the cutter (e.g., a handle portion) and a mechanism or device that facilitates securing blades within the blade storage compartment and preventing the blade storage assembly from being decoupled (or separated) from the portion of the cutter. The blade storage assembly 210 and the handle portion 104 include surfaces (e.g., spring-biased latch elements and complementary engagement surfaces, respectively) that prevent the blade storage assembly from being completely separated from the handle portion.

Figure 16B:
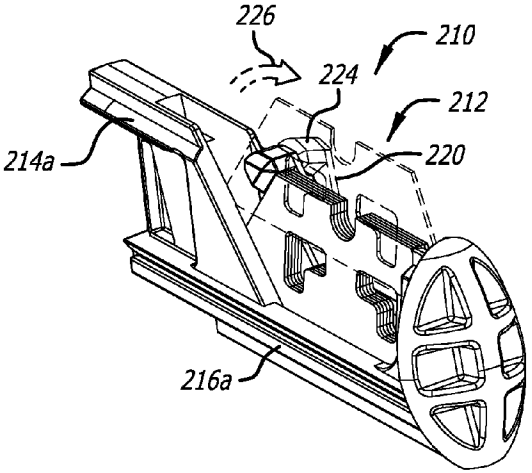
FIG. 16B is another perspective view of the blade storage assembly in which its blade retention spring is shown repositioned in relation to the blade storage compartment for allowing a user of the cutter apparatus to withdraw a blade from the blade storage compartment.
Figure 16A:
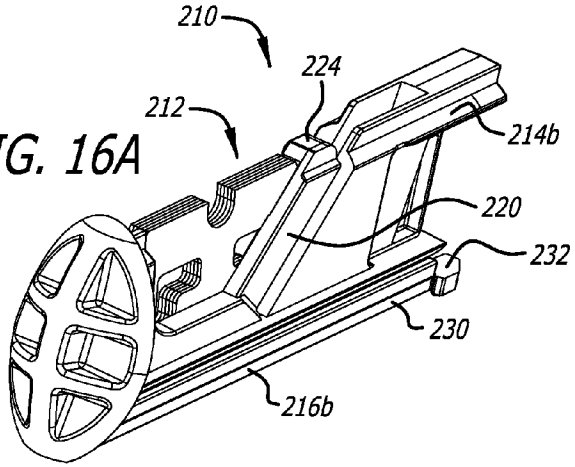
FIG. 16A is a perspective view of the blade storage assembly of the cutter apparatus of FIG. 1.
Figure 17A:
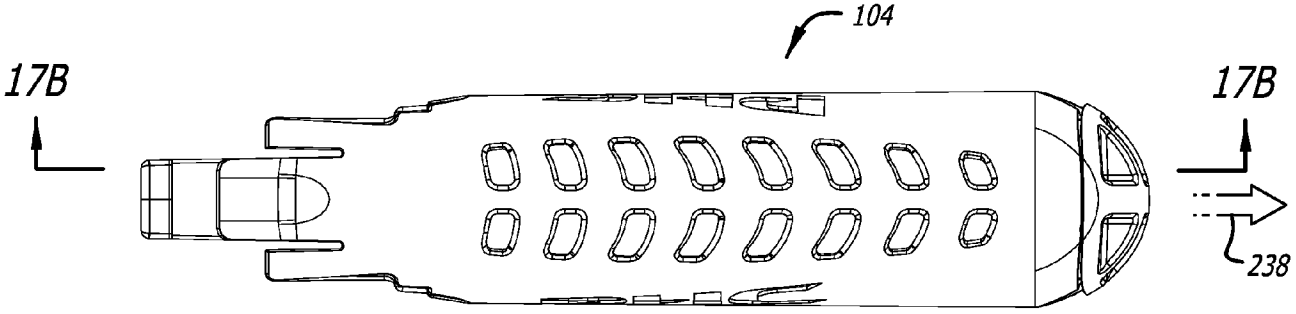
FIG. 17A is a top view of the handle portion of the cutter apparatus of claim 1 in which the blade storage assembly is shown in its fully retracted secured closed position.
Figure 17B:
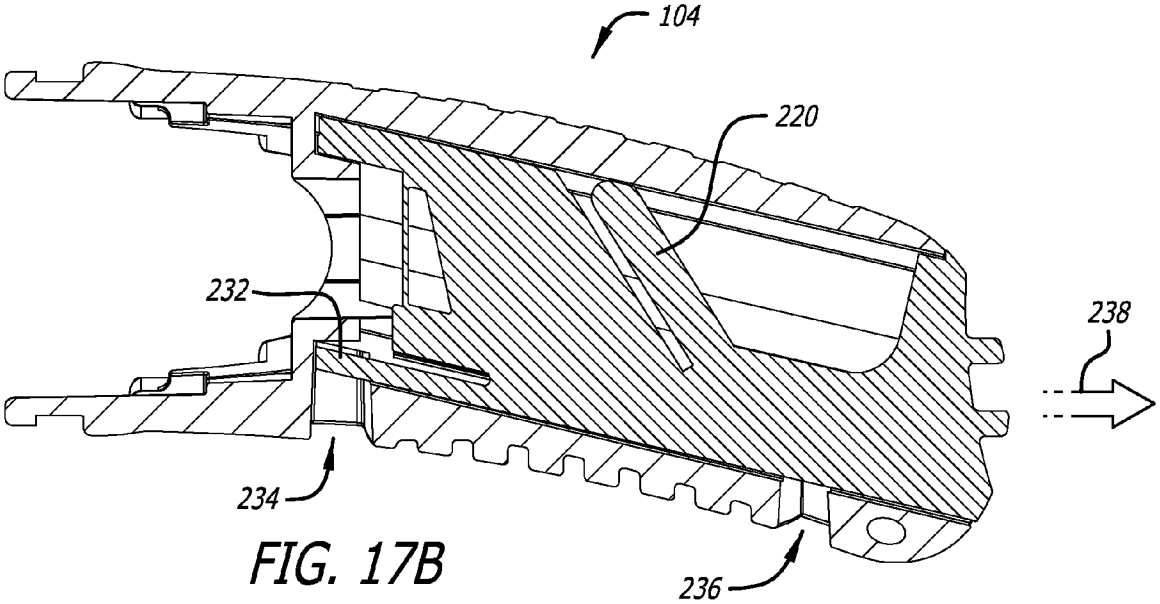
FIG. 17B is a cross-sectional view of the handle portion along lines 17B-17B of FIG. 17A.
Figure 18A:
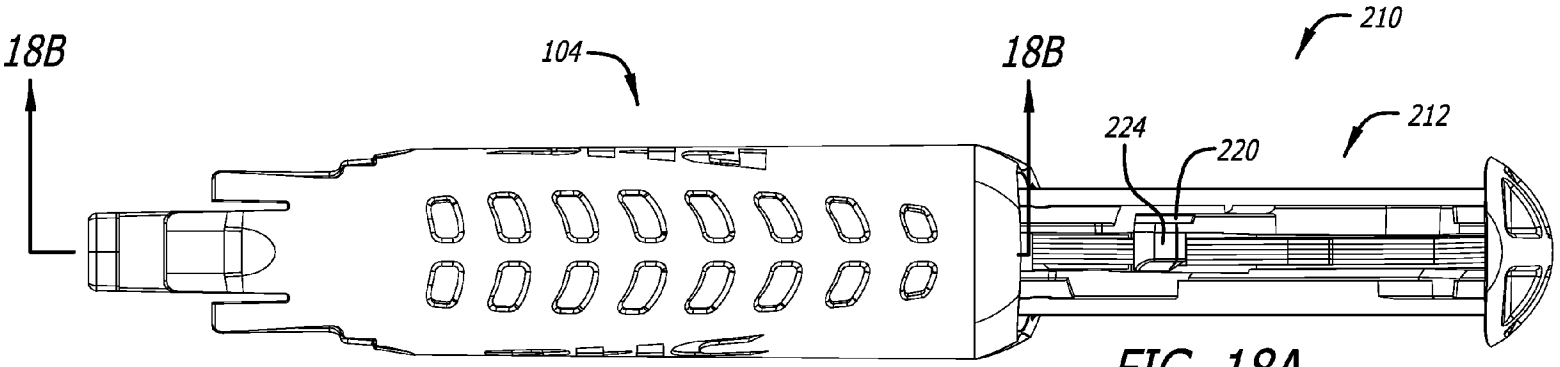
FIG. 18A is a top view of the handle portion of the cutter apparatus of claim 1 in which the blade storage assembly is shown in its fully extended secured open position.
Figure 18B:
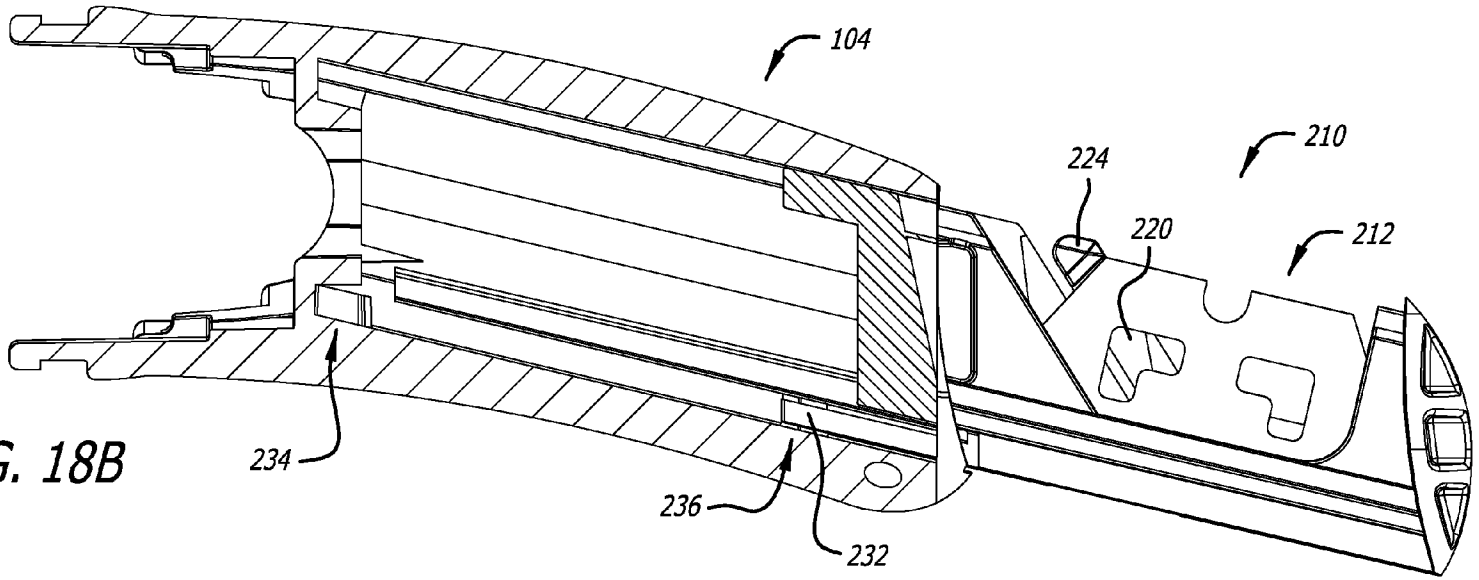
FIG. 18B is a cross-sectional view of the handle portion along lines 18B-18B of FIG. 18A.

The blade storage holder (or compartment) 212 is configured for holding spare blades (e.g., five blades) and includes a plurality of springs (or other biasing components) configured, for example, to perform one or more of: securing blades within the blade storage compartment, controlling how many blades can be simultaneously withdrawn from the blade storage compartment, providing resistance to extending the blade storage assembly from the housing (e.g., during an initial/partial segment of the repositioning movement), and preventing the blade storage assembly from being completely removed from the housing (e.g., via positive lock with the housing). Referring to FIGS. 16A and 16B, in this example embodiment, the plurality of springs includes a first spring 220 (e.g., a plastic spring molded in the blade storage compartment) configured to secure blades within the blade storage compartment (e.g., prevent the blades from falling out) and control how many blades can be simultaneously withdrawn from the blade storage compartment (e.g., only allow withdrawal of one blade at a time). The spring 220 includes a blade retention portion 224 (e.g., with surfaces/portions shaped and configured as shown). In FIG. 16B, the spring 220 is shown (in dashed lines) repositioned in relation to the blade storage compartment 212 as denoted by arrow 226 for allowing a user of the cutter apparatus to withdraw a blade from the blade storage compartment. In this example embodiment, the plurality of springs includes a second spring 230 (e.g., a plastic spring at the base of the spare blade compartment) configured to provide resistance to extending the blade storage assembly from the housing (e.g., latches into the rear body to provide resistance for extending the spare blade compartment) and prevent the blade storage assembly from being completely removed from the housing (when the assembly is extended to gain access to the blade storage compartment). The spring 230 includes an engagement portion (or latch) 232 (e.g., with surfaces/portions shaped and configured as shown), and the handle portion 104 includes recesses 234 and 236 configured to receive the engagement portion 232 therein. Referring to FIGS. 17A and 17B, when the blade storage assembly 210 is in its fully retracted closed position, the engagement portion 232 detents into recess 234 securing the assembly in position until (employing sufficient force to overcome the detent resistance) a user of the cutter apparatus 100 withdraws the assembly as denoted by arrow 238. Referring to FIGS. 18A and 18B, when the blade storage assembly 210 is repositioned to its fully extended opened position, the engagement portion 232 detents into recess 236 securing the assembly for withdrawing a blade from and/or reloading the blade storage compartment 212.

Thus, in an example embodiment, a cutter apparatus includes a housing configured for gripping by a hand, a blade holder and/or a blade coupled to the housing, and a blade storage assembly coupled to and repositionable in relation to a portion of the housing, the blade storage assembly including a blade storage compartment configured for holding spare blades and a plurality of springs configured to secure blades within the blade storage compartment and prevent the blade storage assembly from being completely removed from the housing.

Although the present invention(s) has(have) been described in terms of the example embodiments above, numerous modifications and/or additions to the above-described embodiments would be readily apparent to one skilled in the art. It is intended that the scope of the present invention(s) extend to all such modifications and/or additions.

What is claimed is:

1. A cutter apparatus comprising:

a housing with a blade carrier configured for holding a blade in multiple different cutting edge orientations in relation to the housing, the cutting edge orientations including a pair of cutting edge orientations that are mirror images of each other; and a handle coupled to the housing via an engagement interface including an interior interface on one of the handle and the housing and a bearing on the other of the handle and the housing cooperating with the interior interface and configured to allow a user of the cutter apparatus to selectively interfit together the housing and the handle in multiple different cutter apparatus configurations including a pair of configurations in which the handle is rotatably repositionable in relation to the housing about a rotation axis or vice versa, wherein the rotation axis extends longitudinally in a length direction of the cutter apparatus, and with cutting edge orientations that are mirror images of each other in relation to the handle to accommodate ambidextrous operation of the cutter apparatus.

2. The cutter apparatus of claim 1, wherein the interior interface is configured to slidably and rotatably couple the housing and the handle.

3. The cutter apparatus of claim 1, wherein the engagement interface further includes an exterior interface configured to automatically lock the housing and the handle together when the housing and the handle are repositioned to interfit together in one of the cutter apparatus configurations.

4. The cutter apparatus of claim 3, wherein the exterior interface is configured to allow a user of the cutter apparatus to unlock the housing and the handle by actuating multiple release devices provided on one or more of the housing and the handle.

5. The cutter apparatus of claim 1, wherein the engagement interface further includes a coupler configured to permit the housing and the handle to be repositioned further apart but not decoupled.

6. The cutter apparatus of claim 1, wherein the engagement interface further includes a channel and the bearing being secured within and repositionable in relation to the channel.

7. A cutter apparatus comprising:

a housing with a blade carrier configured for holding a blade in multiple different cutting edge orientations in relation to the housing, the cutting edge orientations including a pair of cutting edge orientations that are mirror images of each other; and a handle coupled to the housing via an engagement interface configured to allow a user of the cutter apparatus to selectively interfit together the housing and the handle in multiple different cutter apparatus configurations including a pair of configurations which, in conjunction with the cutting edge orientations respectively selected from the pair of mirror image cutting edge orientations, accommodate ambidextrous operation of the cutter apparatus;

wherein the engagement interface includes a channel and a bearing secured within and repositionable in relation to the channel;

wherein the channel includes or is provided with an inwardly extending annular ridge and the bearing includes one or more engagement surfaces configured to be repositionable in relation to the channel, the ridge and the bearing being configured such that the ridge prevents the bearing from exiting the channel.

8. A cutter apparatus comprising:

a housing configured for gripping by a hand;

a blade holder and/or blade coupled to the housing;

a guard secured to the housing; and a handle coupled to the housing via an engagement interface including an interior interface on one of the handle and the housing and a bearing on the other of the handle and the housing cooperating with the interior interface and configured to allow a user of the cutter apparatus to selectively interfit together the housing and the handle in multiple different cutter apparatus configurations including a pair of configurations accommodating left and right-handed operation of the cutter apparatus, respectively, in which the handle is rotatably repositionable in relation to the housing about a rotation axis or vice versa, wherein the rotation axis extends longitudinally in a length direction of the cutter apparatus, and in which the guard, in relation to each configuration, faces the blade from right and left sides, respectively, of the cutter apparatus.

9. The cutter apparatus of claim 8, wherein the housing and the handle are tool-lessly reconfigurable.

10. The cutter apparatus of claim 8, wherein the guard includes multiple workpiece contact portions associated with the multiple different cutter apparatus configurations, respectively.

11. A cutter apparatus comprising:

a housing configured for holding a blade, the housing including multiple guards; and a handle coupled to the housing via an engagement interface including an interior interface on one of the handle and the housing and a bearing on the other of the handle and the housing cooperating with the interior interface and configured to allow a user of the cutter apparatus to selectively interfit together the housing and the handle in multiple different engagement positions in which the handle is rotatably repositionable in relation to the housing about a rotation axis or vice versa, wherein the rotation axis extends longitudinally in a length direction of the cutter apparatus such that the housing and the handle are secured together and a different guard is positioned for contact with a workpiece for each of the engagement positions.

* * * * *